United States Patent [19]

Archer et al.

[11] Patent Number: 5,043,925

[45] Date of Patent: Aug. 27, 1991

[54] METHOD AND APPARATUS FOR MODELING BUNKER FLOW

[75] Inventors: David H. Archer, Ross Township, Allegheny Cunty; M. Mushtaq Ahmed, Wilkins Township, Allegheny Cunty, Pa.

[73] Assignee: Westinghouse Electric Corp., Pittsburgh, Pa.

[21] Appl. No.: 393,186

[22] Filed: Aug. 14, 1989

[51] Int. Cl.[5] ..... G06F 15/20

[52] U.S. Cl. ..... 364/550; 364/478; 364/479

[58] Field of Search ..... 364/478, 479, 550

[56] References Cited

U.S. PATENT DOCUMENTS 4,882,927 11/1989 Gould ..... 364/571.03 X

OTHER PUBLICATIONS

Johanson, Jerry, "Know Your Material—How to Predict and Use Properties of Bulk Solids", *Chemical Engineering*, Deskbook Issue, Oct. 30, 1978, pp. 9–17.

Johansdon, Jerry, "Design for Flexibility in Storage and Reclaim", *Chemical Engineering*, Deskbook Issue, Oct. 30, 1978, pp. 19–26.

*Perry's Chemical Engineers Handbook*, McGraw-Hill, 1984, pp. 7-27 to 7-29.

*Flow of Solids Newsletter*, Sep. 1990, vol. X, No. 2.

"On-Line Elemental Analyzer for Bulk Material", Gamma-Metrics, 1987.

*Primary Examiner*—Parshotam S. Lall

*Assistant Examiner*—Edward R. Cosimano

[57] ABSTRACT

A method and apparatus for modeling flow in a bunker detects material characteristics of material supplied to a bunker and predicts the type of flow from the sensed material characteristics. Material characteristics of the material subsequently discharged from the bunker are compared with the material characteristics of the material supplied to the bunker to verify the prediction of flow in the bunker. The method and apparatus can be applied to bunkers storing coal at a power plant where moisture content, heating value, sulphur, etc. are detected by a bulk material analyzer prior to being supplied to a plurality of bunkers. Even if the coal is subsequently mixed prior to combustion, estimates, an be made of the contribution of each bunker to the resulting heating value, moisture removed, sulphur, ash content, etc. An appropriate flow model predicting one of mass flow, rat hole flow and funnel flow can be selected based upon characteristics of the material supplied to and discharged from the bunkers.

20 Claims, 3 Drawing Sheets

METHOD AND APPARATUS FOR MODELING BUNKER FLOW

BACKGROUND OF THE INVENTION

1. Field of the Invention

The present invention is related to monitoring the filling and discharging of material from a bunker and, more particularly, to monitoring the supply of coal from a plurality of bunkers to the burners of a boiler.

2. Description of the Related Art

There is a substantial body of knowledge on how characteristics, such as particle size, moisture content, bunker geometry, etc., affect the distribution of particulate solid material during filling and redistribution resulting from discharge of material in a bunker. However, there have been only preliminary attempts to apply this knowledge to continuously predicting the arrangement of material in a bunker. Since the material in a bunker can vary in composition and flow characteristics due to variation in the source of the material loaded into the bunker, increased knowledge of the arrangement of the material within a bunker would be useful in situations where the composition of the material discharged from the bunker are important.

For example, particulate solid materials, i.e., rocks, stored in bunkers may be mixed or blended in the production of cement. As another example, coal supplied to coal-fired boilers is typically stored temporarily in bunkers prior to feeding the burners of the boiler If the coal varies in sulphur content, knowledge of the content of the sulphur being supplied to the burners at any given time enables the operator of the boiler to avoid exceeding $SO_2$ emission limits. Also, variations in heating value of the coal can affect how the boiler should be operated to maintain desired steam flow, temperature and pressure in the boiler.

No technique is presently available to obtain information regarding the arrangement of material in a bunker. Bulk material analyzers, available from, e.g., GAMMA-METRICS in San Diego, California, have been used in blending and sorting coal by sulphur content and in rock blending by the cement industry. However, there has been only rudimentary attempts to predict the arrangement of material in a bunker so that the material being discharged at any given time can be accurately predicted.

SUMMARY OF THE INVENTION

An object of the present invention is to model flow of material in a bunker.

Another object of the present invention is to predict characteristics of coal discharged from a bunker.

Yet another object of the present invention is to control the supply of coal from a plurality of bunkers to the burners of a boiler.

The above objects are attained by providing a method of using a data processing apparatus to predict arrangement of material in a bunker, comprising the steps of sensing first material characteristics of the material supplied to the bunker and predicting redistribution of the material in the bunker upon discharge of the material from the bunker, in dependence upon the first material characteristics. Preferably, the method also includes predicting distribution of the material in the bunker during filling of the bunker. In addition, second material characteristics of the material can be sensed upon discharge of the material from the bunker and the redistribution prediction of the material can be modified in dependence upon the second material characteristics.

Examples of material characteristics to be sensed include moisture content and chemical composition. When the material is coal discharged from the bunker for use as fuel, the amount of one or more of the elements in the coal and the heating value of the coal are also useful as material characteristics. For example, the amount of sulphur in the coal loaded into the bunker can be compared with the amount of sulphur as $SO_2$ in exhaust gases to provide an indication of the accuracy of the redistribution prediction.

These objects, together with other objects and advantages which will be subsequently apparent reside in the details of construction and operation as more fully hereinafter described and claimed, reference being had to the accompanying drawings forming a part hereof, wherein like reference numerals refer to like parts throughout.

DESCRIPTION OF THE PREFERRED EMBODIMENTS

Figure 1:
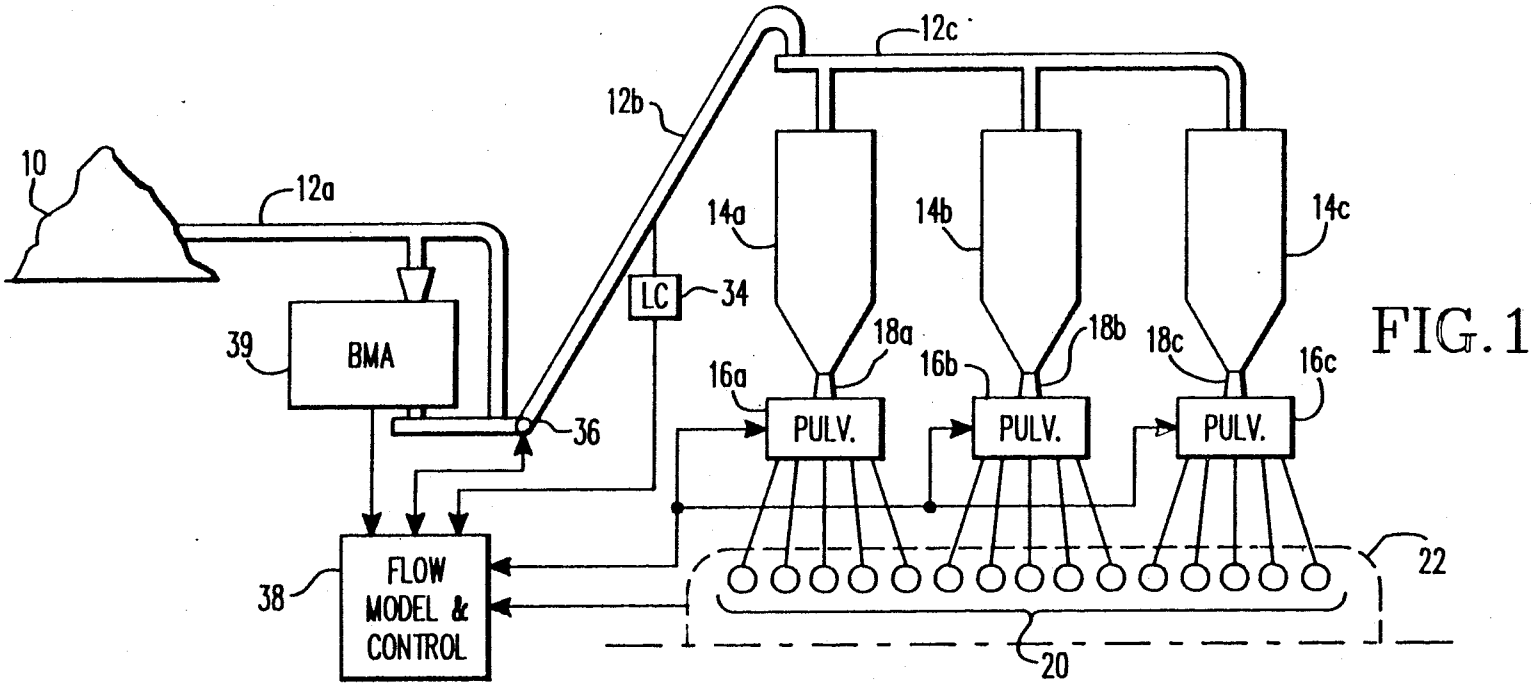
FIG. 1 is a block diagram of a system according to the present invention.

As illustrated in FIG. 1, coal 10 is conventionally supplied via transport means, such as belts **12*a*–12*c*. The coal is transferred from the final belt 12*c* to one or more bunkers 14*a*–14*c***. Typically, the rate of coal supply and size of bunkers is such that with all coal going to a single bunker, the bunker can be filled in, e.g., 15 minutes to 2 hours. This filling provides a supply of coal which may last for, e.g., 6 to 8 hours.

In a typical coal-fired power plant, coal discharged from bunkers is transferred to one or more pulverizers. In the embodiment illustrated in FIG. 1, three pulverizers **16*a*–16*c*, each corresponding to one of the bunkers 14, are provided. In practice, many other arrangements are employed, such as using a pulverizer 16 which can receive coal from several of the bunkers 14. In FIG. 1, transfer means, such as belts 18*a*–18*c* transfer the coal from the bunkers 14 to the pulverizers 16. In a plant with a single pulverizer, the transfer means could be a single horizontal belt running below all of the bunkers and ending at the single pulverizer 16**.

Figure 2C:
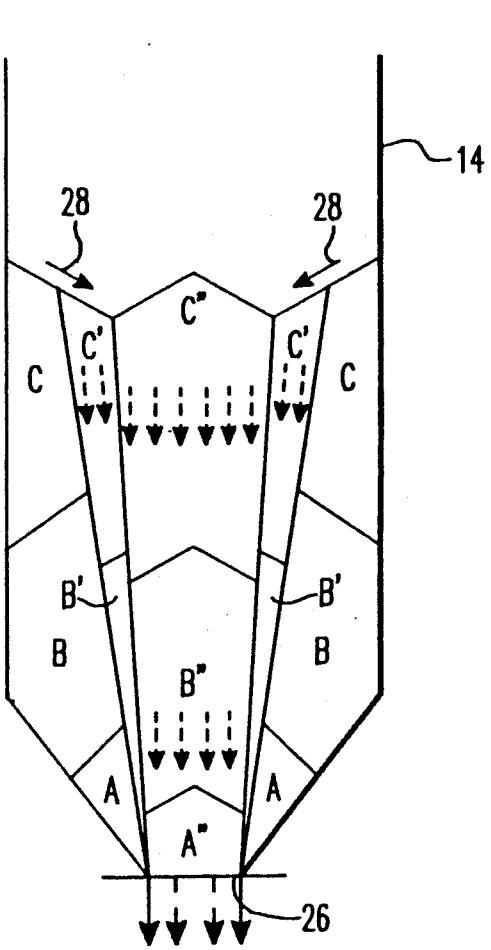

The pulverizers **16*a*–16*c* illustrated in FIG. 1 typically grind and dry the coal by passing heated air through the coal. The air is then typically used to carry the coal to burners 20 which heat a boiler 22. The boiler 22 is indicated by a dashed line in FIG. 1 since it is typically located above the pulverizers. As in the case of the relationship between the pulverizers 16 and bunkers 14, other arrangements of pulverizers 16 and burners 20 besides the one illustrated in FIG. 1 are used. For example, all of the burners 20 could be supplied with coal from any of the pulverizers 16, by simply providing cross connections. As coal or any other material is supplied to a bunker 14 having a vertical cross section like that illustrated in FIG. 2A, the material is distributed in the bunker 14 in a manner which depends in part upon the material characteristics of the coal, particularly moisture content and particle size distribution. In the example illustrated in FIG. 2A, the fall line of the coal, indicated by dashed line 24 was slightly off-center by the same amount for each of three different loadings, or charges, to the bunker 14**. As indicated by the different angles of inclination or repose, the initial charge A of coal has different material characteristics than the second charge B and third charge C. The larger angle of repose, i.e., the steeper slope, of the initial charge A indicates that the initial charge A was most likely moister or finer (or both) than the subsequent charges B and C. On the other hand, the second charge B was most likely drier or coarser than either the initial charge A or third charge C.

There are three major types of flow in bunkers. The first is called mass flow where the flow velocity is essentially the same throughout the region of the bunker with vertical walls and constant cross section. If mass flow occurs, all or most of the initial charge A will be discharged from the outlet 26 of the bunker 14 before any of the second charge B is discharged. Due to the large angle of repose of the initial charge A, some of the coal in the second charge B near the walls of the bunker 14 may be discharged prior to the top of the initial charge A. On the other hand, the small angle of repose of the second charge B will result in virtually all of the second charge B being discharged prior to the third charge C, if all three charges exhibit mass flow.

Figure 2B:
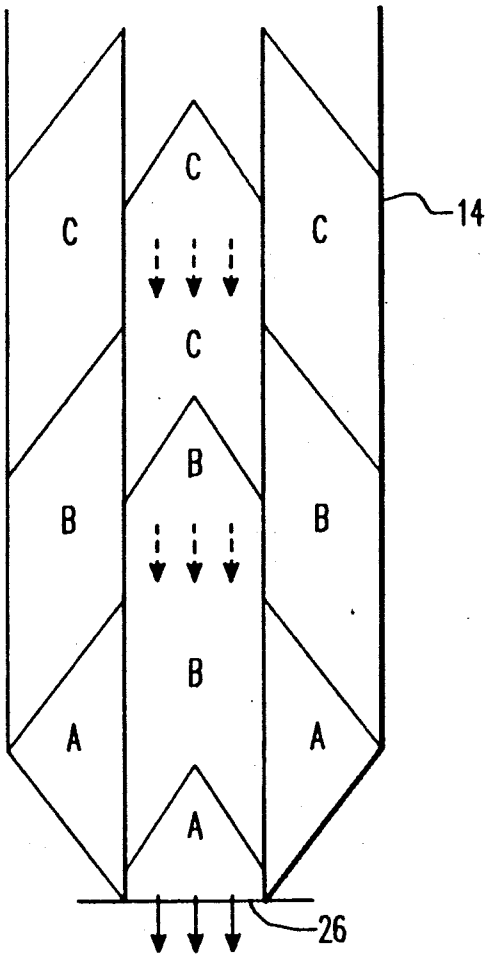
Figure 2A:
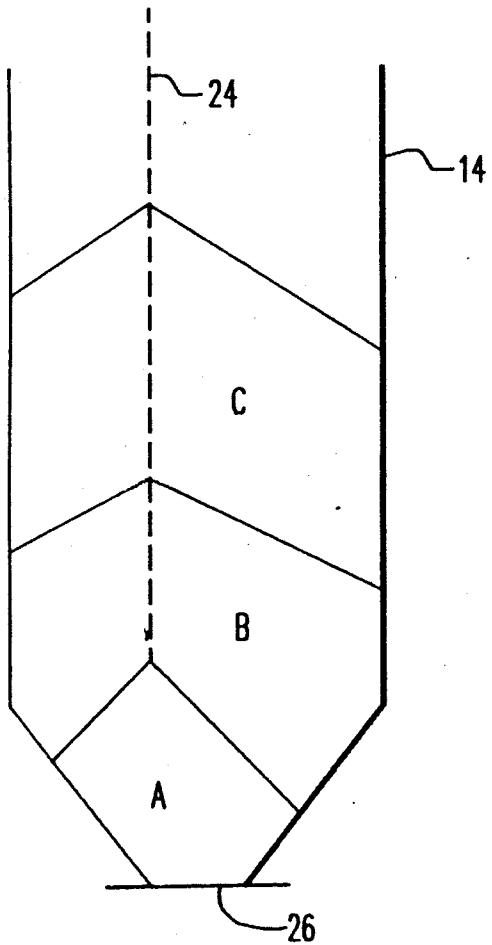

The second major type of flow in a bunker is termed rat hole flow and is illustrated in FIG. 2B. Rat hole flow is typically observed with moister, finer particles. As illustrated in FIG. 2B, during rat hole flow, only the coal directly above the outlet 26 is discharged and the remainder of the material in the bunker 14 remains stacked along the sides. This flow results in only a small portion of the contents of a bunker 14 being discharged when the outlet 26 is opened. For this reason, air blasters and vibrators are typically employed to remove material from the sides of a bunker when rat hole flow occurs.

The most common form of flow in a bunker is funnel flow. Any flow in a bunker which is not mass flow or rat hole flow may be categorized as funnel flow. One example of funnel flow is illustrated in FIG. 2C. Funnel flow is characterized by a portion of the material, e.g., coal 10, near the walls of the bunker 14 remaining stationary, as occurs in rat hole flow, but the portion of the material which flows is not limited to the material directly above the outlet 26. In the example illustrated in FIG. 2C, it is assumed that the outlet 26 is circular and that there are two distinct conical regions of flow. The larger central conical region indicated by A", B" and C", moves with uniform flow velocity over each cross section at the highest rate of speed. The surrounding conical region, indicated by B' and C', moves at lower, non-uniform speeds. As indicated by the arrows 28, material flows from the top of the outermost regions toward the central conical region as the material in the central conical region is discharged. Other types of funnel flow in a bunker include only a single conical region moving en masse and a surrounding region in which no flow occurs. When funnel flow occurs, the interface between the moving and stationary regions of material can range between vertical (rat hole flow) and the angle of the lower portion of the bunker (mass flow). Furthermore, the above descriptions of all three types of flow have been simplified or "idealized" compared to actual flow where other factors such as the fall line and flow characteristics (angle of repose and angle of internal friction) of the material, geometry of the bunker, surface characteristics of the bunker, etc., affect the actual flow.

Figure 3E:
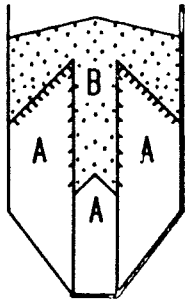
FIGS. 2A–2C and 3A–3E are examples of different arrangements of coal in a bunker.

The present invention uses available knowledge regarding how differences in moisture content, flow characteristics of particular coals, bunker geometry, etc., affect flow in a bunker to predict redistribution of the material in the bunker upon discharge of the material. In addition, the present invention predicts distribution of the material in the bunker during filling. As noted above, drier, coarser coal is more likely to exhibit mass flow and have a smaller angle of repose, while moister, finer coal tends toward rat hole flow and will typically have a greater angle of repose. Examples of the result of filling a bunker with two charges of coal having different characteristics are illustrated in FIGS. 3A–3E. In FIGS. 3A–3C, a second charge B of coal is added to the bunker before the initial charge A is discharged. In FIG. 3A, the two charges of coal have substantially the same material characteristics and thus the same angle of repose. In FIG. 3B, the second charge B of coal is finer or moister than the initial charge A and thus has a greater angle of repose. On the other hand, the second charge B in the example illustrated in FIG. 3C is coarser or drier and thus has a greater angle of repose.

Figure 3D:
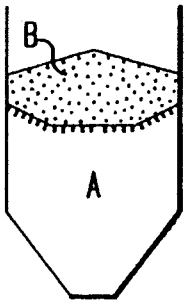
Figure 3C:
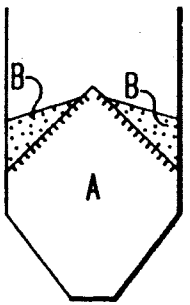
Figure 3B:
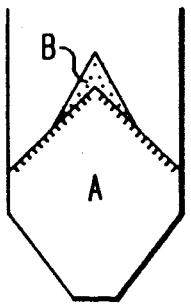
Figure 3A:
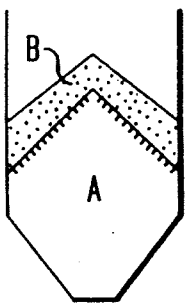

FIG. 3D illustrates an example where the initial charge A of coal has been partially discharged in funnel flow when the second charge B is added. Upon further discharge, there will be a significant amount of mixing of charges A and B after approximately 50% of initial charge A has been discharged. However, one of the characteristics of funnel flow is that eventually all of the coal will be discharged without requiring any external force.

On the other hand, FIG. 3E illustrates an example of rat hole flow in the partially discharged initial charge A. One of the characteristics of rat hole flow is that the majority of the coal remains in the bunker until an external force, such as an air blast or bunker vibration, frees the coal from the sides of the bunker. In the example illustrated in FIG. 3E, the second charge B is coarser or drier as indicated by the lesser angle of repose. As a result, the second charge B is likely to exhibit funnel flow or mass flow. Therefore, upon further discharge the central region of the initial charge A will be discharged followed by the majority of the second charge B. Unless an external force is applied to the bunker, flow will stop after less than half of the contents of the bunker have been discharged and the majority of the discharge will be coal in the second charge B, even though had there been mass flow in the bunker, none of the second charge B would have been discharged until more than half of the contents of the bunker was discharged. Thus, the importance of modeling flow and filling in the bunker should be apparent.

Figure 4:
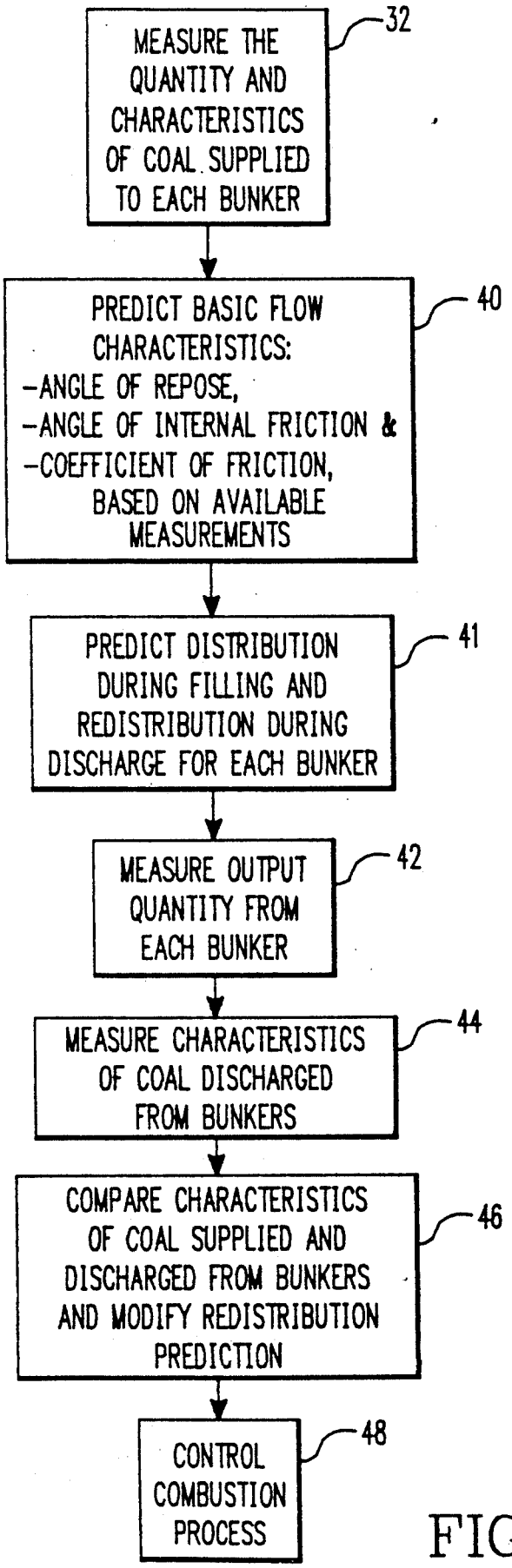
FIG. 4 is a flow chart of a method according to the present invention.

It is possible to maintain a model of the arrangement of material by applying a method represented by the flow chart illustrated in FIG. 4. First, it is necessary to measure 32 the quantity and characteristics of coal supplied to each bunker. In the case of the coal storage and transport system illustrated in FIG. 1, the quantity of coal transported by belt **12*b* can be determined from the mass of coal sensed by load cell 34 and the speed at which a drive roller 36 drives the belt 12*b*. The speed may be determined by a speed sensor integrated with the drive roller 36, or assumed from a speed command issued by a flow model and control unit 38 to the drive roller 36**, or sensed by a separate speed sensor (not shown). The rate of movement of the coal in, e.g., feet per second, times the mass of coal in, e.g., pounds per feet, equals the quantity of coal being supplied.

Normally, coal is supplied to only one bunker at a time using what are termed trippers which cause the coal on the belt 12c to be diverted into one of the bunkers 14a–14c. Note that while only three bunkers are illustrated in FIG. 1, in conventional installations a single belt may supply coal to several bunkers and in some arrangements the coal may be diverted off of either side of a belt running between a parallel row of bunkers.

In the preferred embodiment, the characteristics of the coal are sensed or inferred by a bulk material analyzer 39. As described above, bulk material analyzers are able to detect quickly the quantity of elements in a large amount of material and to identify its nature and source. Thus, information such as moisture content, sulphur content, nitrogen content, and ash content of coal can be detected by the bulk material analyzer 39. If there is variation in other pertinent characteristics of the material, such as particle size, additional sensors can be added. For example, the size of particles can be detected by any conventional means, such as a plurality of screens of different sizes which sort the material for weighing, or optical or other size identifying techniques can be used.

In the illustrated embodiment, only a portion of the coal 10 which is supplied to the bunkers 14 passes through the bulk material analyzer 39. So long as a representative sample passes through the bulk material analyzer 39, this arrangement is satisfactory. Depending upon the quantity of material supplied to the bunkers and the capacity of the bulk material analyzer 39, all of the material could be analyzed by the bulk material analyzer 39.

The bulk material analyzer 39 can provide additional information, such as heating value of the coal 10. The heating value can be calculated using known techniques from the elemental and ultimate analyses provided by the bulk material analyzer 39. This information is provided to the flow model and control unit 38 which maintains a model of the arrangement of material in each of the bunkers during different loading periods. This includes predicting 40 basic flow characteristics including angle of repose, angle of internal friction and coefficient of friction from the coal characteristics previously measured 32. The material flow characteristics are used to predict 41 the distribution of the material in each of the bunkers 14 during filling of and withdrawal from each bunker 14. Most importantly, the analysis of the coal 10 or other material provided by the bulk material analyzer 39 or other sensors is combined 40 with knowledge of how variations in pertinent material characteristics affect the flow of the particular material stored in the bunkers 14. As noted above, a considerable body of knowledge already exists for many types of materials including coal. However, since the geometry of the bunker 14 and the surface characteristics, i.e., smoothness and hardness of the inner surface of the bunker 14, affect the flow of material, a certain amount of fine tuning of the flow model will be necessary for bunkers having different construction.

The accuracy of the bunker flow model is preferably improved by measuring 42 the output quantity from each bunker 14 and measuring 44 the characteristics of the material discharged from the bunkers. The quantity of material discharged can be measured in the same manner used for measuring the quantity of material supplied to the bunkers 14 or using existing sensors. In the case of coal 10 supplied to burners 20, the pulverizers 16 typically control the amount of coal 10 being supplied and thus information on the quantity of coal 10 being supplied can be obtained from the pulverizers 16 or equipment controlling the operation of the pulverizers 16.

In the embodiment illustrated in FIG. 1, a single unit 38, such as a micro- or mini-computer from any of several manufacturers, is illustrated as providing both flow modeling and control. However, these functions can be separated with communications between the units to the degree required for the flow model unit to obtain information on the coal 10 discharged from the bunkers 14 and to the degree that operation of the pulverizers 16 is to be controlled in dependence upon the models of the arrangement of coal 10 in the bunkers 14.

Other characteristics of the coal 10 can also be obtained from the pulverizers 16 or from sensors mounted near the pulverizers 16. For example, one of the functions of pulverizers 16 is to dry the coal 10 prior to supplying the coal 10 to the burners 20. This is accomplished by heating air supplied to the pulverizers 16. By sensing the temperature of the air before and after flowing through the coal 10 discharged from the bunker 14, an indication of the moisture removed from the coal 10 can be provided to the flow model and control unit 38.

The prediction 41 of distribution and redistribution of material in the bunkers enables the flow model and control unit 38 to generate predicted characteristics of material discharged from each of the bunkers 14. In the case of moisture content, the moisture content sensed by the bulk material analyzer 39 for coal predicted to be discharged by the flow model can be compared 46 with the indication of moisture actually removed from the coal 10 to provide an indication of the accuracy of the model. Correction of the model based upon such information can be either automatic by appropriate heuristic programming or by fine tuning the modeling program manually.

Other characteristics of the coal 10 discharged from the bunkers 14 can also be used to verify the accuracy of the models maintained by the flow model and control unit 38. For example, temperature and pressure in, and steam flow and heat loss from the boiler 22, can be sensed and used to calculate the heating value of the coal 10 used for firing the boiler 22. This heating value can be compared with the heating value corresponding to the coal 10 predicted to be discharged from the bunker 14. Differences between the heating values can be used to modify the redistribution prediction. Alternatively, the quantity of sulphur in exhaust gases or the quantity of iron in the ash produced by the combustion process can be detected using various sensors (not shown). For example, sulphur dioxide ($SO_2$) is conventionally monitored at power plants and thus existing sensors may already be in place.

Which of the material characteristics are chosen for monitoring depends upon which characteristics vary the most at a particular site. In the case of coal-fired power plants, moisture content may vary depending upon the length of time that coal is exposed outdoors before it is used. Some coal-fired plants use coal with a fairly consistent amount of sulphur, while others obtain coal with varying sulphur content from different sources. In the former cases, moisture content and heating value may be the only material characteristics which are monitored in the coal 10 discharged from the bunkers 14. In the latter case, variations in the quantity of sulphur in the exhaust gases may be the most significant indicator of the type of coal 10 being supplied to the burners 20. In a similar fashion, the present invention can be tailored to modeling the flow of other materials in a bunker using the material characteristics which are most relevant to that material At a coal-fired plant having a coal supply system like that illustrated in FIG. 1, the pulverizers 16*a*–16*c* may be operated simultaneously. Similarly, a single pulverizer 16 can receive coal 10 simultaneously from several bunkers 14 where a single belt (not shown) is disposed below a row of bunkers 14 to feed the single pulverizer 16, as described previously. In such situations, the coal 10 from more than one of the bunkers 14 has an effect on the material characteristics, such as heating value, moisture removed, sulphur quantity, etc., of the coal 10 discharged from the bunkers 14. In such cases, the flow model and control unit 38 must make an estimate of the effect on the material characteristics of the coal 10 discharged from the bunkers 14 in order for a comparison to be made between the material characteristics of the coal 10 supplied to the bunkers 14 and the material characteristics of the coal 10 discharged from the bunkers 14.

As noted above, the flow model and control unit 38 can be used to control 48 the combustion process, as indicated in the flow chart illustrated in FIG. 4. This control may include regulating the belts 12 to supply coal 10 when needed to a bunker 14, controlling the pulverizers 16 to supply a sufficient amount of coal 10 to maintain desired steam flow, temperature and pressure in the boiler 22, etc. In addition, when the flow model and control unit 38 predicts 41 the existence of rat hole flow in one of the bunkers 14, air blasters or vibrators (not shown) can be automatically instructed to produce an external force on the bunkers 14 to redistribute the coal 10 therein, whether or not sensors (not shown) have detected a cessation in the flow of coal 10 from the bunker 16.

The many features and advantages of the present invention are apparent from the detailed specification and thus, it is intended for the appended claims to cover all such features and advantages of the system which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. A method of using a data processing apparatus to predict arrangement of material in a bunker, comprising the steps of:

(a) sensing first material characteristics of the material supplied to the bunker; and (b) predicting redistribution of the material in the bunker upon discharge of an amount of material from the bunker in dependence upon the first material characteristics sensed in step (a) and the amount of material discharged.

2. A method as recited in claim 1, wherein the material is coal used as fuel in a combustion process, and wherein said method further comprises the step of (c) controlling the combustion process in dependence upon said predicting in step (b).

3. A method as recited in claim 1, wherein step (b) comprises predicting one of rat hole, funnel and mass flow of the material during discharge from the bunker.

4. A method as recited in claim 3, further comprising the steps of:

(c) measuring input quantities of the material supplied to the bunker during different loading periods; and (d) measuring output quantities discharged from the bunker during different outflow periods, and wherein said predicting in step (b) takes into account differences int he first and second material characteristics in each of the loading and outflow periods, respectively.

5. A method as recited in claim 1, further comprising the step of (c) predicting distribution of the material in the bunker during filling of the bunker.

6. A method as recited in claim 5, further comprising the steps of:

(d) sensing second material characteristics of the material discharged from the bunker; and (e) modifying said predicting in step (b) in dependence upon the second material characteristics.

7. A method as recited in claim 6, wherein the material is coal through which air passes after discharge of the coal from the bunker.

wherein step (a) comprises sensing at least moisture content of the coal supplied to the bunker as the first material characteristic, and wherein step (d) comprises:

(d1) sensing temperature of the air before and after flowing through the coal discharged from the bunker; and (d2) calculating moisture removed from the coal as the second material characteristic.

8. A method as recited in claim 6, wherein the material is coal used as fuel for a boiler after discharge from the bunker, wherein said method further comprises the step of (f) calculating a first heating value of the coal from the first material characteristic sensed in step (a);

wherein step (d) comprises sensing temperature and pressure in the boiler and steam flow and heat losses from the boiler, and wherein step (e) comprises the steps of:

(e1) calculating a second heating value of the coal used for heating the boiler;

(e2) comparing the first and second heating values to detect differences therebetween; and (e3) modifying said predicting in step (d) in dependence upon the differences detected by said comparing in step (e2).

9. A method as recited in claim 6, wherein the material is coal discharged from the bunker for use in a combustion process producing ash and exhaust gases, wherein step (a) comprises sensing at least one element in the coal supplied to the bunker, as the first material characteristic, and wherein step (d) comprises sensing the at least one element in at lest one of the ash and exhaust gases, as the second material characteristic.

10. A method as recited in claim 9, wherein step (d) comprises measuring sulphur in the exhaust gases.

11. A method as recited in claim 9, wherein step (a) comprises analyzing the coal supplied to the bunker using a bulk material analyzer.

12. A method of using a data processing apparatus to predict arrangement of material in a plurality of bunkers temporarily storing the material, comprising the steps of:

(a) sensing first material characteristics as the material is supplied to each of the bunkers;

(b) sensing second material characteristics of the material discharged from the bunkers; and (c) predicting the arrangement of the material in each of the bunkers in dependence upon the first and second material characteristics sensed in steps (a) and (b).

13. A method as recited in claim 12, wherein step (c) comprises the steps of:

(c1) predicting distribution of the material during filling of the bunkers;

(c2) predicting redistribution of the material in each of the bunkers upon discharge of the material, including generating predicted characteristics of the material discharged from each of the bunkers;

(c3) modifying said predicting in step (c2) in dependence upon differences between the predicted characteristics and the second material characteristics corresponding thereto; and (c4) maintaining a model of the arrangement of the material in each of the bunkers in dependence upon said predicting in steps (c1) and (c2).

14. A method as recited in claim 13, wherein step (b) comprises sensing at least one of the second material characteristics when material from more than one of the bunkers has an effect on the second material characteristic, and wherein step (c) comprises the step of estimating the effect on the at least one of the second material characteristics by the material discharged from each of the bunkers.

15. A method as recited in claim 14, wherein the material is coal through which air passes after discharge of the coal from the bunkers, wherein step (a) comprises sensing moisture content of the coal supplied to the bunkers as one of the first material characteristics, and wherein step (b) comprises sensing temperature of the air before and after flowing through the coal discharged from the bunkers to detect moisture removed from the coal as one of the second material characteristics.

16. A method as recited in claim 15, wherein the coal discharged from the bunkers is used in a common combustion process, wherein step (a) further comprises sensing at least one element in the coal supplied to each of the bunkers as another of the first material characteristics; and wherein step (b) further comprises sensing at least one element, included in the second material characteristics, in at least one of ash and exhaust gases produced by the combustion process.

17. A method as recited in claim 15, wherein the coal discharged from the bunkers is used in a common combustion process to heat a boiler, wherein step (b) comprises sensing temperature and pressure in the boiler and steam flow and heat losses from the boiler, and wherein said method further comprises the steps of:

(d) calculating a heating value of the coal from the first material characteristics sensed in step (a);

(e) calculating a second heating value of the coal upon use of the coal to heat the boiler;

(f) comparing the first and second heating values to detect differences therebetween; and (g) modifying said predicting in step (c) in dependence upon the differences detected by said comparing in step (f).

18. A system for monitoring coal temporarily stored in bunkers and used in a combustion process, said system comprising:

supply sensing means for sensing quantity and characteristics of the coal supplied to each of the bunkers during filling of the bunkers, the characteristics including at least one of moisture content, sulphur content, ash producing chemical content and a first heating value;

combustion sensing means for sensing products of the combustion process, the products including at least one of moisture removed from the coal, a sulphur quantity, ash composition and a second heating value; and modeling means for predicting arrangement of the coal in the bunkers in dependence upon the characteristics of the coal and the products of the combustion process.

19. A system as recited in claim 18, wherein said supply sensing means comprises:

a bulk material analyzer, operatively connected to said modeling means, for providing an elemental analysis of the coal and for calculating the first heating value of the coal;

a speed sensor, operatively connected to said modeling means, for sensing a rate of movement of the coal; and a mass sensor, operatively connected to said modeling means, for sensing mass of the coal supplied to the bunkers.

20. A system as recited in claim 19, wherein the coal is dried after discharge from the bunkers and prior to heating contents of a boiler during the combustion process, wherein said combustion sensing means comprises:

moisture sensing means for sensing the moisture removed from the coal prior to combustion;

boiler sensing means for sensing temperature and pressure in the boiler; and calculation means for calculating the second heating value from the temperature and pressure in the boiler and the steam flow and heat losses from the boiler, and wherein said modeling means comprises means for adjusting predictions of the arrangement of the coal in the bunkers in dependence upon differences between the first and second heating values.

* * * * *